US008282533B1

(12) United States Patent
Ferraro et al.

(10) Patent No.: US 8,282,533 B1
(45) Date of Patent: Oct. 9, 2012

(54) RESILIENT STABLE TRAMPOLINE BOARD WITH BINDINGS

(75) Inventors: Michael Robert Ferraro, Orlando, FL (US); Gregg Anton Vukelic, Renton, WA (US)

(73) Assignee: Voda Equipment, LLC, Orlando, FL (US)

( * ) Notice: Subject to any disclaimer, the term of this patent is extended or adjusted under 35 U.S.C. 154(b) by 0 days.

(21) Appl. No.: 13/406,563

(22) Filed: Feb. 28, 2012

(51) Int. Cl.
*A63B 69/18* (2006.01)
*A63C 5/16* (2006.01)

(52) U.S. Cl. ..... 482/27; 482/51; 434/253; 280/14.22

(58) Field of Classification Search ..... 482/51, 482/15, 27, 148, 70; 280/14.22, 842; 434/253, 434/247

See application file for complete search history.

(56) References Cited

U.S. PATENT DOCUMENTS 4,940,226 A * 7/1990 Carra ..... 482/51
5,207,445 A * 5/1993 Hoelzl ..... 280/607
5,312,258 A * 5/1994 Giorgio ..... 434/253
5,649,722 A * 7/1997 Champlin ..... 280/818
5,839,747 A * 11/1998 Gervasoni ..... 280/611
6,832,979 B1 * 12/2004 Yarbrough ..... 482/77
6,942,487 B2 * 9/2005 Corbalis ..... 434/247
7,314,227 B2 * 1/2008 Sanders ..... 280/602
D566,215 S * 4/2008 Ellis et al. ..... D21/765
7,703,794 B2 * 4/2010 O'Hara ..... 280/618
7,748,722 B2 * 7/2010 Kane ..... 280/14.22
2004/0227311 A1 * 11/2004 Sanders ..... 280/14.22
2005/0042954 A1 * 2/2005 Pacha ..... 441/65
2005/0048853 A1 * 3/2005 Pacha ..... 441/65
2005/0212258 A1 * 9/2005 Enders ..... 280/602
2006/0119055 A1 * 6/2006 Heidlebaugh ..... 280/14.22
2011/0227317 A1 * 9/2011 Holbird, Jr. ..... 280/626

* cited by examiner

*Primary Examiner* — Stephen Crow
(74) *Attorney, Agent, or Firm* — Mark Young, PA

(57) ABSTRACT

A trampoline board includes a resilient body with a foam core. At least one flex zone (e.g., a channel) which acts as a living hinge extends from a first lateral edge to a second lateral edge to facilitate bending to conform to the shape of a depressed trampoline surface. Sandal-like trampoline board bindings are threadedly coupled to inserts molded into the resilient body. Each binding includes a shock absorbing mid-sole and is devoid of any potentially harmful structures that extend above the ankle of a user, such as the molded support behind the heel characteristic of snowboard bindings. Adjustable cushioned straps secure the sandal-like trampoline board bindings to a user's feet. The insert pack includes a base with a plurality of parallel threaded shanks extending perpendicularly therefrom.

14 Claims, 9 Drawing Sheets

RESILIENT STABLE TRAMPOLINE BOARD WITH BINDINGS

FIELD OF THE INVENTION

This invention generally relates to trampoline boards, and more particularly, to a resilient stable trampoline board adapted to bend and conform to the contour of a deflected trampoline during a downward landing, return to and maintain a substantially undeflected stable configuration upon rebound and during airborne maneuvers, and provide low profile adjustable bindings suitable for use without boots.

BACKGROUND

For many years, water and snow sport enthusiasts honed their aerial skills by practicing on a trampoline with a board attached to their feet. Illustratively, an article in the Aug. 31, 1997 edition of The Denver Post, DENVER & THE WEST; Pg. B-06, illustrates and explains that "Fuzz Federson . . . of the U.S. Freestyle Ski Team does some snowboard moves from a trampoline Saturday as he and other members of the team helped entertain people in the long lines, above, that formed outside Gart Bros. sporting goods store at East 10th Avenue and Broadway . . . . " Similar public trampoline performances using snowboards with snowboard bindings are reported in the Jun. 11, 1997 edition of the Hobart Mercury (Australia), "A few experts . . . demonstrated what they could do with a snowboard and trampoline in a crowded Elizabeth Mall in Hobart yesterday;" as well as in a Jan. 14, 1997 PR Newswire article reporting that Three Time World Freestyle Skiing Champion, Trace "The Ace" Worthington will make personal appearances and perform his ski and snowboard trampoline show at Tommy Hilfiger New Generation shops across the country. Likewise, a Jan. 1, 1997 article in the Washing Post, Prince William Extra; Pg. V08, entitled A New Twist for Snowboarding Enthusiasts; Local Gym, Stores Provide Resources To Learn About Sport explains " . . . that's exactly what some local snowboard enthusiasts are doing these days at the gymnastics club on Morse Lane, using a large trampoline to practice complicated moves. The string-bed netting, after all, is a lot softer on the backside than frozen ground."

As the use of boards on a trampoline has gained popularity, various trampoline boards have been devised. After all, snow boards and wakeboards are expensive, may damage a trampoline surface, may become damaged on springs and frames of a trampoline or by falling off a trampoline, tend to slip on a trampoline surface, and may injure a user. Alternative boards include various soft-sided board-like structures that will not damage the trampoline or injure the user, but suffer other shortcomings.

Many conventional foam boards lack sufficient rigidity to provide a realistic training experience. In use, the board loses stability (i.e., flops around) when airborne, which interferes with training because it does not realistically simulate the feel of maneuvering a snowboard, wakeboard or skateboard. Upon landing on a trampoline under the weight of a user, the foam becomes substantially compressed and provides an insubstantial substrate for propelling the user upwardly or compensating for a skewed landing.

When conventional boards (e.g., snowboards, skateboards and wakeboards) are used on trampolines, they do not flex sufficiently to conform to the trampoline surface during jumps, which tends to dampen the bounce of the board off the trampoline. The dampening effect limits the maximum jump height achieved, affecting the user's ability to execute training maneuvers properly. Additionally, even if the edges of the board may be covered, the hard surface of the board poses a risk to users.

U.S. Pat. No. 6,196,558 to Simon discloses a board referred to as a footboard with straps through holes or snowboard bindings to secure the footboard to a user's feet. Simon discloses a limited range of materials for the footboard composition, including wood (e.g., plywood), fiberglass, plastic, carbon fiber, aluminum, and other similar materials, or composites of such materials. Straps through holes do not provide a secure means for binding, nor do they emulate the bindings of conventional boards. Snowboard bindings are undesirable because such bindings are designed to accommodate bulky boots not worn during trampboarding. Additionally, snowboard bindings feature a stiff molded support behind the heel and up the calf area to allow riders to apply pressure and effect a "heelside" turn on the slopes. Unfortunately, however, the molded support is conducive to injury by digging into the user's legs and derriere during trampoline use.

Accordingly, a need exists for a resilient stable trampoline board adapted to configured to bend and conform to a deflected trampoline during downward motion and return to and maintain a substantially undeflected configuration during airborne maneuvers. The invention is directed to overcoming one or more of the problems and achieving one or more of the advantages as set forth above.

SUMMARY OF THE INVENTION

In one exemplary embodiment of a trampoline board according to principles of the invention, a resilient body with a foam core is provided. The resilient body resembles a sports board such as a wakeboard, snowboard, skateboard or other sports board. The resilient body is sized to attach two feet of a user. The resilient body includes top and bottom surfaces, a tip and a tail, and first and second lateral edges, the top surface including at least one flex zone (e.g., a channel) extending from the first lateral edge to the second lateral edge, said at least one channel facilitating bending of the board to conform to the shape of a depressed trampoline surface. At least one furrow may be provided along a portion of the first lateral edge and at least one furrow may be provided along a portion of the second lateral edge. A plurality of parallel channels, each extending from the first lateral edge to the second lateral edge, and each facilitating bending and conformity to a trampoline surface may be provided. The channels act as living hinges.

Flex zones are portions of reduced thickness (i.e., thickness measured from top surface to bottom surface) at locations on the board (e.g., the midline between tip and tail) where flexibility is desired to easily conform to the deformed surface of a trampoline under tension. The flex zones facilitate controlled bending. Concomitantly, the board is resilient, returning to its unbent configuration upon rebound, without fluttering while airborne.

In another aspect of an exemplary embodiment of the invention, trampoline board bindings are threadedly coupled to the resilient body and configured to receive a left foot and right foot of a user and secure the user's left and right feet to the trampoline board. The bindings are sandal-like structures being sized and configured to accommodate bare feet, but may also accommodate feet in socks or street footwear. They do not accommodate snow boots. Each binding includes a sole comprising an insole that contacts a user's foot, an outsole that contacts the top surface of the resilient body of the trampoline board, and a shock absorbing midsole. The bindings are devoid of any structure that extends above the ankle of a user, such as the molded support behind the heel characteristic of snowboard bindings. The bindings further include at least one cushioned adjustable strap passing over an instep and at least one cushioned adjustable strap passing around a heel and/or ankle.

In another aspect of an exemplary embodiment of the invention, an insert pack is molded into the resilient body of the trampoline board and configured to threadedly couple the resilient body to trampoline board bindings configured to receive a left foot and right foot of a user and secure the user's left and right feet to the trampoline board. The insert pack includes a base with a plurality of parallel threaded shanks extending perpendicularly therefrom. The shanks have a free end extending to the deck. The base is molded into the body between the top and bottom surfaces. The bindings including means (e.g., screws or other threaded couplings) for threadedly engaging threaded shanks of said insert pack. The insert pack may comprise separate components, one for the left foot binding and one for the right foot binding, or may comprise an integrated elongated unit with an intermediate stiffening joint.

In another aspect of an exemplary embodiment of the invention, an elongated resilient stringer may molded into the body parallel to the centerline along the longitudinal axis from tip to tail and between the first and second lateral edges of the resilient body of the trampoline board. The stringer may be perforated to improve adhesion.

In another aspect of an exemplary embodiment of the invention, the foam core is ethylene vinyl acetate (EVA), high-rebound polyurethane (HRPU), or polyethylene. The top and bottom surfaces are skins comprising high density polyethylene (HDPE), extruded polyurethane, or a spandex fabric with an extruded polyurethane exterior sheet heat laminated to the spandex fabric and forming an outer layer of the top surface. An anti-slip pad may also be attached to the bottom surface of the body of the trampoline board.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the invention is not limited to the exemplary embodiments depicted in the figures or the shapes, relative sizes, proportions or materials shown in the figures.

DETAILED DESCRIPTION

Figure 1:
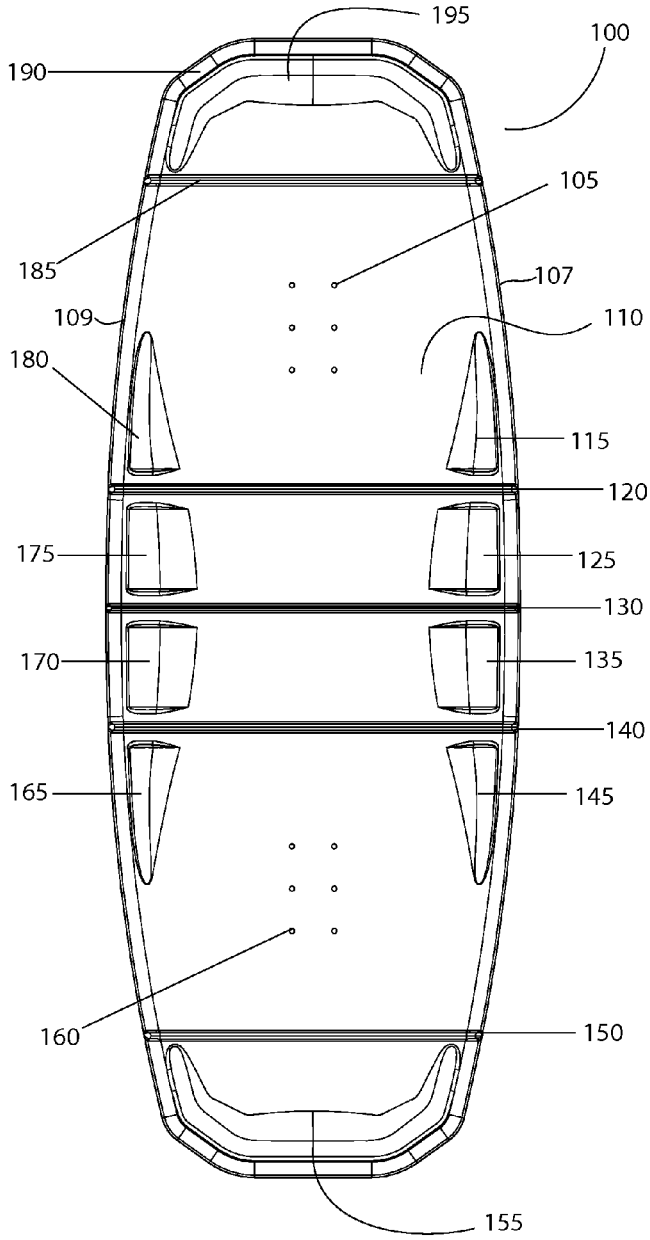
FIG. 1 is a plan view of an exemplary trampoline board in accordance with principles of the invention.
Figure 2:
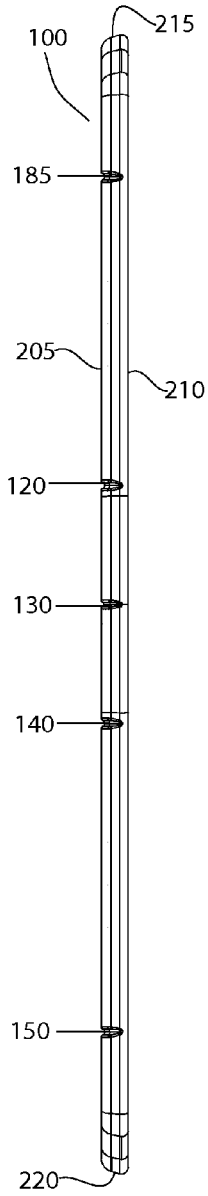
FIG. 2 is a profile view of an exemplary trampoline board in accordance with principles of the invention.
Figure 3:
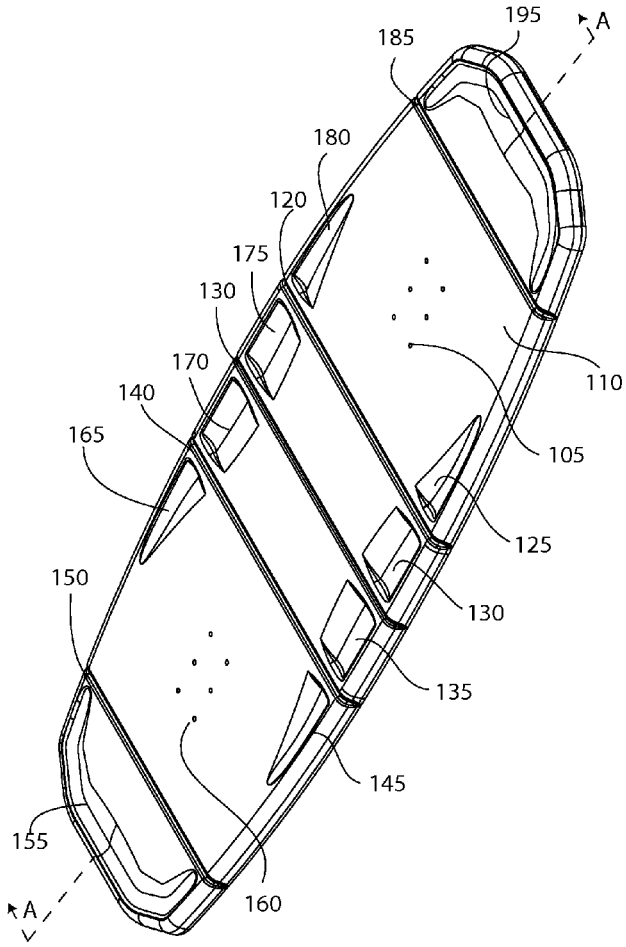
FIG. 3 is a perspective view of an exemplary trampoline board in accordance with principles of the invention.

A trampoline board (i.e., board) according to one embodiment of the present invention is shown in FIGS. 1, 2 and 3, generally indicated at 100. The body 110 of the board 100 includes top 205 and bottom 210 surfaces and a tip 215 and a tail 220. The top surface 205 (also known as the deck) of the trampoline board includes a plurality of furrows 115, 125, 135, 145, 165, 170, 175, 180 along the lateral edges 107, 109, as well as furrows 155, 195 along the tail 220 and tip 215, to facilitate gripping. These furrows are also known as grab rails. In addition to providing a gripping surface, the grab rails enhance stiffness through corrugation. A plurality of channels 120, 130, 140, 150 and 185 (e.g., generally v- or u-shaped furrows) extend from one lateral edge 107 to the opposite lateral edge 109. The lateral edges 107, 109 are also known as rails. The channels 120, 130, 140, 150 and 185, which facilitate bending (i.e., folding) of the board 100 during use by serving as a living hinge or a joint more easily bendable than portions of the body 110 without the channels, are each a type of "flex zone" as described herein. Profile views of these channels 120, 130, 140, 150 and 185 are provided in the cross-section view A-A of FIG. 4.

Flex zones are portions of reduced thickness (i.e., thickness measured from top surface to bottom surface) at locations on the board (e.g., the midline between tip and tail) where flexibility is desired to easily conform to the deformed surface of a trampoline under tension. Flex zones act as living hinges, which facilitate controlled bending (i.e., bending during impact with a trampoline surface to conform to the shape of the trampoline surface as it deflects). Concomitantly, the board is resilient, returning to its unbent configuration upon rebound, without fluttering (i.e., rapid and repeated up and down movement of the tip and tail) while airborne. Fluttering is avoided by providing sufficient rigidity to avoid substantial vibratory motion, such as by providing a sufficiently high modulus of elasticity and one or more constraining inserts.

Figure 5:
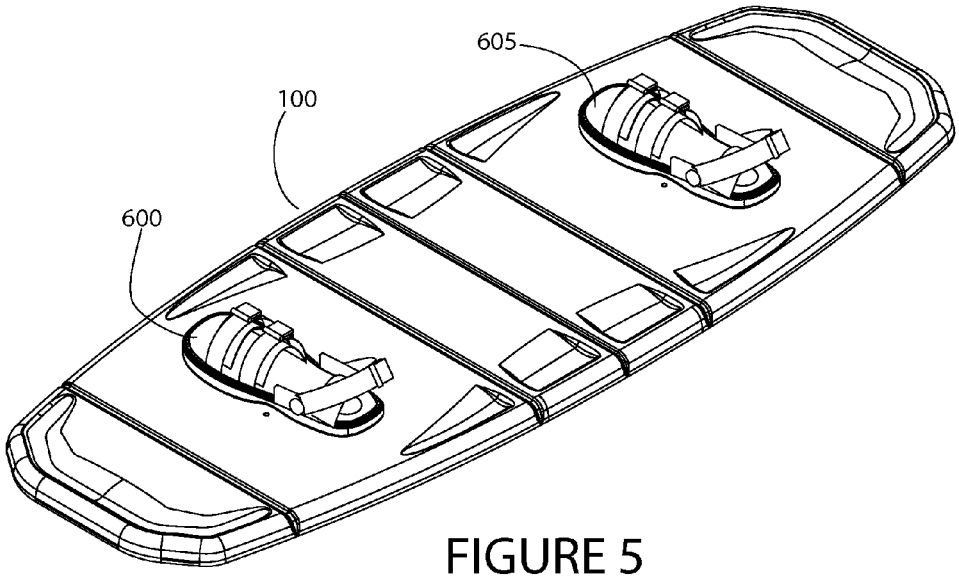
FIG. 5 is a perspective view of an exemplary trampoline board with bindings in accordance with principles of the invention.
Figure 6:
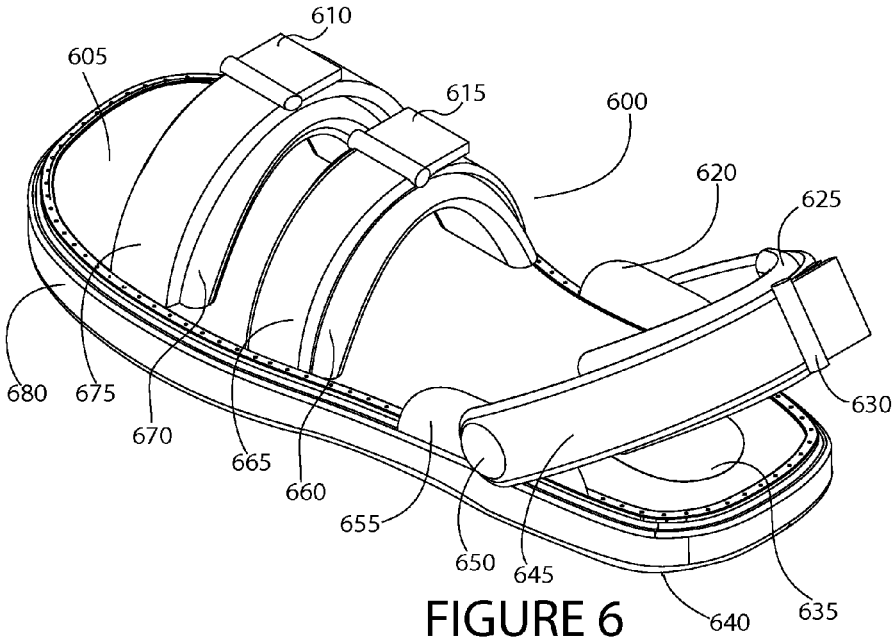
FIG. 6 is a perspective view of an exemplary foot binding for a trampoline board in accordance with principles of the invention.

Referring now to FIGS. 5 and 6, exemplary bindings 600 605 are shown. Bindings 600, 605 are separate components from the trampoline board deck and are very important parts of the total trampoline board 100 interface. The main function of the bindings 600, 605 is to hold the user's feet in place tightly so energy is transmitted between the board and user, without enhanced risk of injury to the user. The bindings 600, 605 are attached to the board with a plurality of screws that engage inserts molded into the board 100, as discussed more fully below.

While a wide range of bindings may be used in connection with a trampoline board in accordance with principles of the invention, key features of a preferred binding 600 are conceptually illustrated in FIG. 6. Notably, the binding 600 is sized and configured to accommodate a bare foot, a foot in a sock and/or a foot in ordinary street footwear. The binding 600 generally resembles a sandal, an open type of footwear, consisting of a sole held to the wearer's foot by cushioned straps 665, 675 passing over the instep and one or more cushioned straps 645 around the heel and/or ankle. The sole comprises a soft insole 605 that sits directly beneath the wearer's foot and is sized to be slightly larger than the foot, an outsole 640 that directly contacts the deck of the trampoline board, and, between the insole 605 and outsole 640, a midsole 680 (preferably a resilient intermediate layer) that provides shock absorption. The rear part of the insole 605 includes a heel pad 635 or cup to accept, stabilize and support the heel of a foot. A cushion 625, 660, 670 is attached to the insole side of each strap 645, 665, 675 to comfort a wearer. The heel strap 645 is adjustably (e.g., pivotally) attached to the sole. By way of example, pivot pins 650, pivotally attach the heel strap 645 to support flanges 620, 650. The straps 645, 665, 675 may be adjusted using buckles, clamps, ratchets 610, 615, 630 (e.g., as in the case of ratchet straps which are widely used in snowboard and wakeboard bindings) or other mechanical releasable securing devices.

The sole may be used to secure the binding 600 to the deck 205. By way of example and not limitation, the insole 605 may be removable to reveal screws or other attachment means for securing the binding to a trampoline board 100. After the binding is secured, the insole may be adhesively or mechanically (e.g., via adhesive or hook and loop fasteners) secured back in place on the sole to protect a foot from the attachments. The outsole 640 provides a secure surface between the attachments and the deck 205 of the board 100. Alternative mountings such as a plate and thumbscrew base mounting system may be provided as is commonly provided in conventional wakeboard bindings.

The exemplary trampoline board bindings differ substantially from wakeboard and snowboard bindings, neither of which is well suited for safe and effective trampoline use. Notably, the binding does not have any features that may gouge, scratch, dig in or otherwise injure a user during trampoline maneuvers. By way of example and not limitation, the binding does not have stiff molded supports behind the heel and up the calf area to allow riders to apply pressure and effect a "heelside" turn on the slopes, as do snowboard bindings. Nor does the binding have a stiff molded foot and ankle support as commonly found in wakeboard bindings. Extended molded features as the stiff molded support in the case of a snowboard binding and the stiff molded foot and ankle support in the case of a wakeboard binding are conducive to injury by digging into the user's legs, calves and derriere during trampoline maneuvers.

Another notable difference between the exemplary trampoline board bindings and conventional wakeboard and snowboard bindings is the resilient midsole 680. During trampoline maneuvers, shocks are repeatedly transmitted through the sole of the binding 600. The midsole 680 provides a stable, resilient, shock absorbing layer between the insole 605 and outsole 680, which is a unique feature that is neither required nor found in wakeboard or snowboard bindings.

Figure 7:
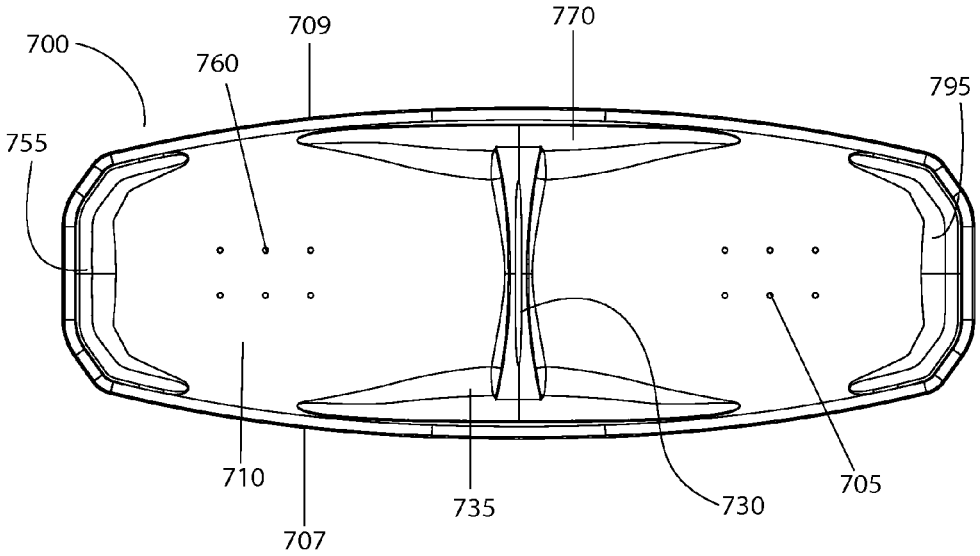
FIG. 7 is a plan view of an alternative exemplary trampoline board in accordance with principles of the invention.
Figure 8:
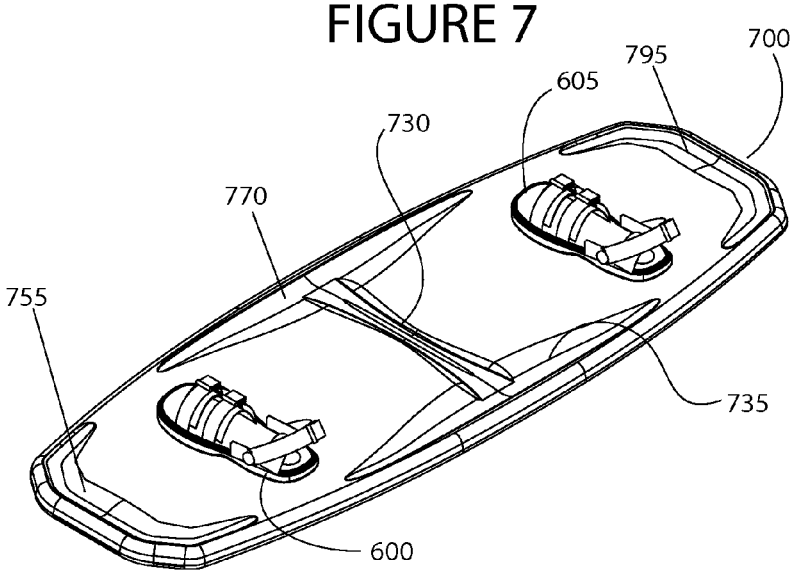
FIG. 8 is a perspective view of an alternative exemplary trampoline board with bindings in accordance with principles of the invention.

The invention is not limited to the board shape, configuration or arrangement of components as shown in the Figures. For example, arrangements of furrows and channels other than as shown in FIGS. 1 through 4 are feasible and intended to come within the scope of the invention. Likewise, the board may be shaped to resemble a wakeboard, snowboard, skateboard or any other sports or recreation board. Illustratively, an alternative trampoline board (i.e., board) is shown in FIGS. 7, and 8, generally indicated at 700. The deck of the body 710 of the board 700 includes a plurality of furrows 735, 770 along the lateral edges 707, 709, as well as furrows 755, 795 along the tail and tip, to facilitate gripping. A central (i.e., between tip and tail) divergent (i.e., expanding in width from the midline to lateral edges) channel 730 extends from one lateral furrow 735 to the opposite lateral furrow 770. The channel 730 facilitates bending (i.e., folding) of the board 700 during use.

Figure 9:
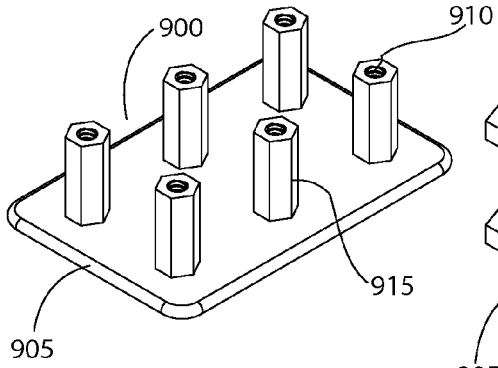
FIG. 9 is a first perspective view of an exemplary insert pack for bindings for a trampoline board in accordance with principles of the invention.
Figure 10:
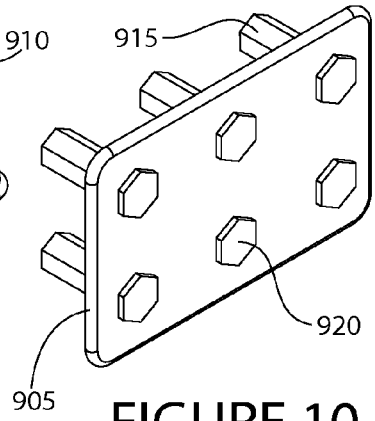
FIG. 10 is a second perspective view of the exemplary insert pack for bindings for a trampoline board in accordance with principles of the invention.
Figure 11:
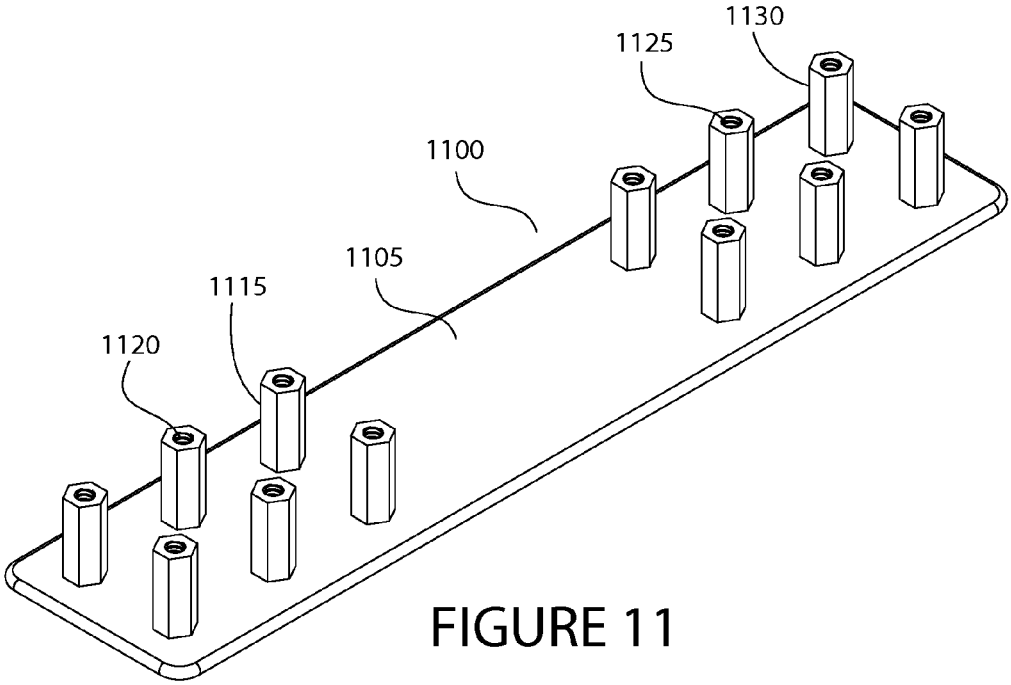
FIG. 11 is a perspective view of an exemplary unitary insert pack with a stiffening joint for bindings for a trampoline board in accordance with principles of the invention.

Referring now to FIGS. 9, 10 and 11, exemplary inserts are shown. Inserts 900 or 1100 (also known as insert packs) are molded into the body 110 of the board 100 for purposes of securing the bindings 600. Pluralities of exposed threaded tips 105, 160 of the inserts 900 or 1100 are accessible for attachment of bindings at the deck 205. The inserts 900, 1100 comprise a broad sheet-like base 905, 1105 with parallel threaded shanks 915, 1115, 1130 extending perpendicularly therefrom. The broad base 905, 1105 enhances retention of the inserts in the body 110 of the board 100. Threaded apertures 910, 1120, 1125 are provided to receive screws from bindings. The shanks 915, 1115, 1130 are configured to receive screws from compatible trampoline board bindings. The shanks may preferably be configured not to accept conventional wakeboard and snowboard bindings, to avoid misuse. Heads 920 at the bottom of the shanks prevent the shanks from being withdrawn from the base 905, 1105 when under a tensile force. The shanks 915, 1115, 1130 may be molded or bonded to the base 905, 1105. The key difference between the insert in FIGS. 9 and 10 and the insert in FIG. 11, is that the insert in FIGS. 9 and 10 is a separate discrete unit for one binding, while the insert in FIG. 11 is an integrated unit with an intermediate stiffening joint 1105 to provide enhanced rigidity and retention.

One or more elongated flexible stiffeners (also known as stringers) may be molded into the body 110 of the board 100 parallel to the lateral edges to enhance rigidity, reduce deformation, and add stiffness and recoil to the body 110. The stiffeners may be perforated and/or textured to enhance bonding with and resist delamination from the core 1205 of the body 110. If a single stringer is used, it may be placed in the center of the board midway between and running parallel to the lateral edges. Stiffeners may be comprised of ABS, PVC, polyethylene, carbon, graphite, bamboo or similar structural materials.

Figure 4:
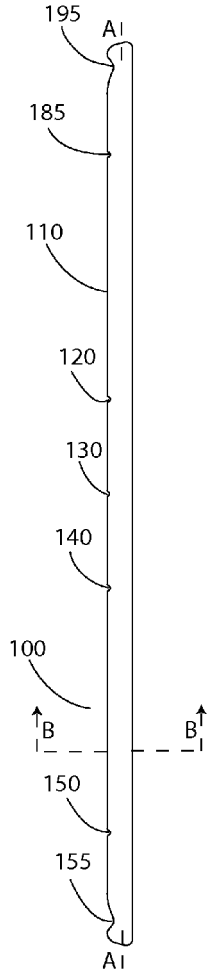
FIG. 4 is a cross section (A-A) view of an exemplary trampoline board in accordance with principles of the invention.
Figure 12:
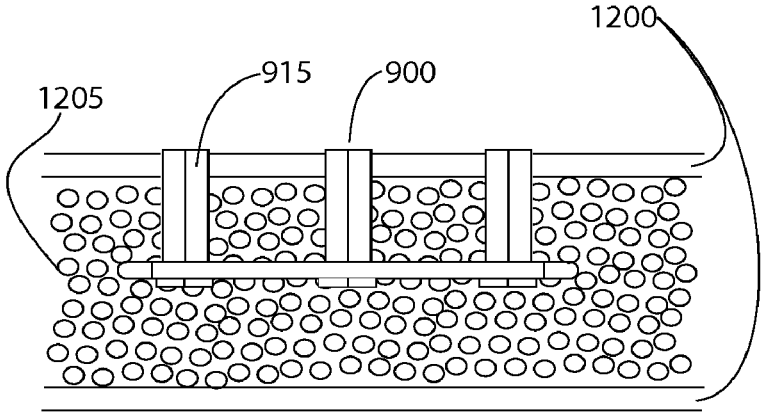
FIG. 12 is a cross section (B-B) view of an exemplary insert pack molded in a trampoline board in accordance with principles of the invention.
Figure 13:
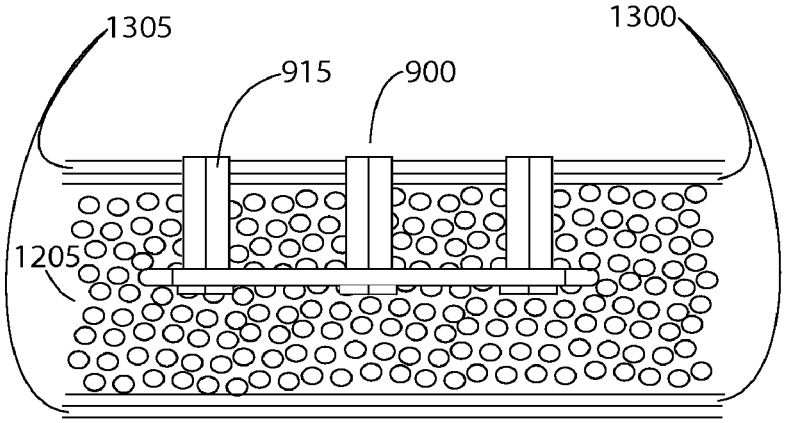
FIG. 13 is a cross section (B-B) view of an exemplary insert pack molded in an alternative trampoline board in accordance with principles of the invention.

Referring to FIG. 12, a cross-section of trampoline board 100, taken along line B-B of FIG. 4, is shown. Body 110 of trampoline board 100 includes a core section 1205, a bottom skin and a top skin 1200. An insert 900 is molded into the core 1205, with the free ends of the threaded shanks being accessible at the top skin 1200 which covers the deck 205. The core 1205 may comprise a thermoplastic or thermoset elastomer, such as ethylene vinyl acetate (EVA), high-rebound polyurethane (HRPU) or other similar materials. The core may be approximately as thick as a conventional wakeboard, e.g., between 0.25 and 1.5 inches. The top and bottom skins 1200 may comprise a solid polymer sheet having good durability, such as high density polyethylene (HDPE), extruded polyurethane or Surlyn® (DuPont) thermoplastic. By way of example and not limitation, in one embodiment, the body 110 may comprise an HRPU core 1205 with a spandex or elastane fabric intermediate layer 1300 (as shown in FIG. 13) and an extruded polyurethane exterior sheet 1305 heat laminated to the spandex intermediate layer 1300. Suitable spandex or elastane fabrics include Lycra®, a trademark of Invista (formerly part of DuPont), Elaspan® (also Invista's), Dorlastan® (Asahi Kasei) and Linel® (Fillattice). In another embodiment, an EVA core 1205 may be encased in HDPE skins 1200. The bottom skin 1200 may be textured and/or have a tackiness. Advantageously, such materials may be bent to conform to a trampoline surface, but may also be sufficiently rigid to avoid fluttering.

The body 110 of the board 100 may be decorated with text and graphics. For example, text and graphics may be printed or otherwise displayed on the outer layer. Alternatively, text and graphics may be sublimated on the intermediate spandex layer and visible through a transparent or translucent outer polyurethane layer. Inks or dyes, after being sublimated, diffuse or otherwise transfer into the spandex layer and thereafter remain as a durable decoration. In this way, even after extensive use of the board, the inks beneath the surface are exposed so that the text and graphics endures and remains vibrant.

Figure 14:
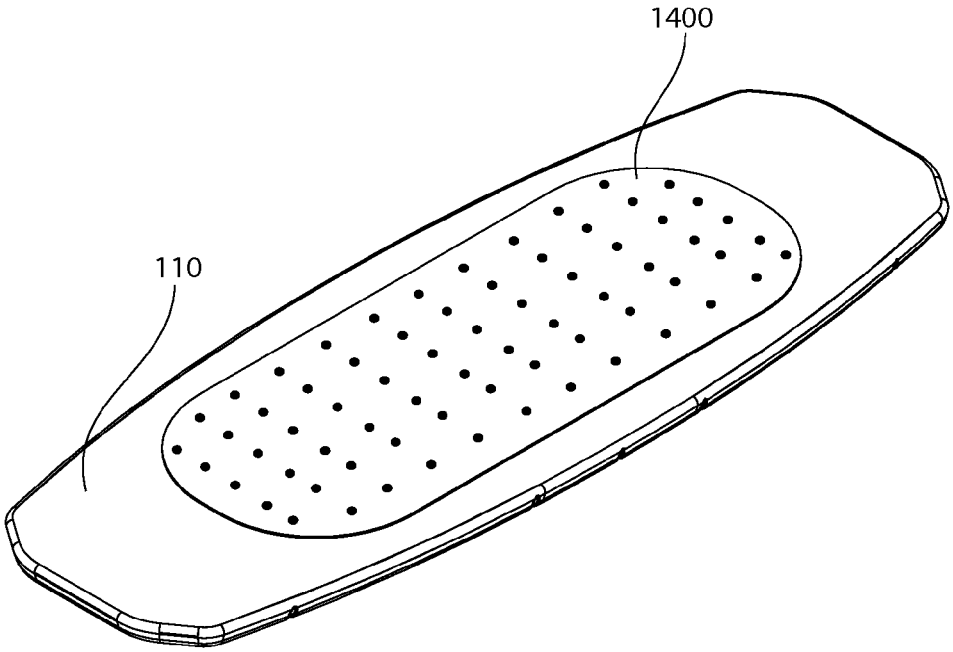
FIG. 14 is a bottom perspective view of an exemplary trampoline board in accordance with principles of the invention.

Optionally, an antislip pad 1400 (or coating) may be provided on the bottom surface of the body 110 of the board 100 as shown in FIG. 14. The pad 1400 features a high coefficient of friction to enhance traction and prevent a rider from slipping off of trampoline while using the board 100. An exemplary pad 1400 may be comprised of any pliable sheet-like materials, including cured silicone, Neoprene® (DuPont), or polyurethane gel.

One method of manufacturing trampoline boards according to principles of the invention entails placing sublimated spandex skins in a mold and drawing a vacuum to force the skins to conform tightly to the shape of the mold. The mold includes a top half and a bottom half with an interface along the midline of the board between the top and bottom surfaces, ports for drawing a vacuum and, optionally, ports for introducing resin between the skins. After the skins are placed into the mold, inserts for threadedly attaching bindings to the board 100 are placed into the mold. Using support pins as spacers, the base 905, 1105 of the inserts 900, 1100 are maintained in a position with the threaded engagement shafts extending to the deck. Next, the resin comprising the core is injected, poured, drawn or otherwise introduced into the space between the mold halves and skins. Then the mold halves are urged together under controlled pressure and temperature allowing the resin to cure. When the curing process completes, the molded board with attached skin may be removed from the mold. Any excess skin material may be trimmed and melted to form a clean edge. An extruded transparent polyurethane sheet may then be heat laminated to the spandex layer. A sacrificial layer may be used to protect the core from melting and distortion while the polyurethane sheet is heat laminated to the core. Next, the top polyurethane skin is heeled to the sides and edges of body. Heeling may be done by hand application of pressure and heat using irons, or a similar operation.

Figure 15:
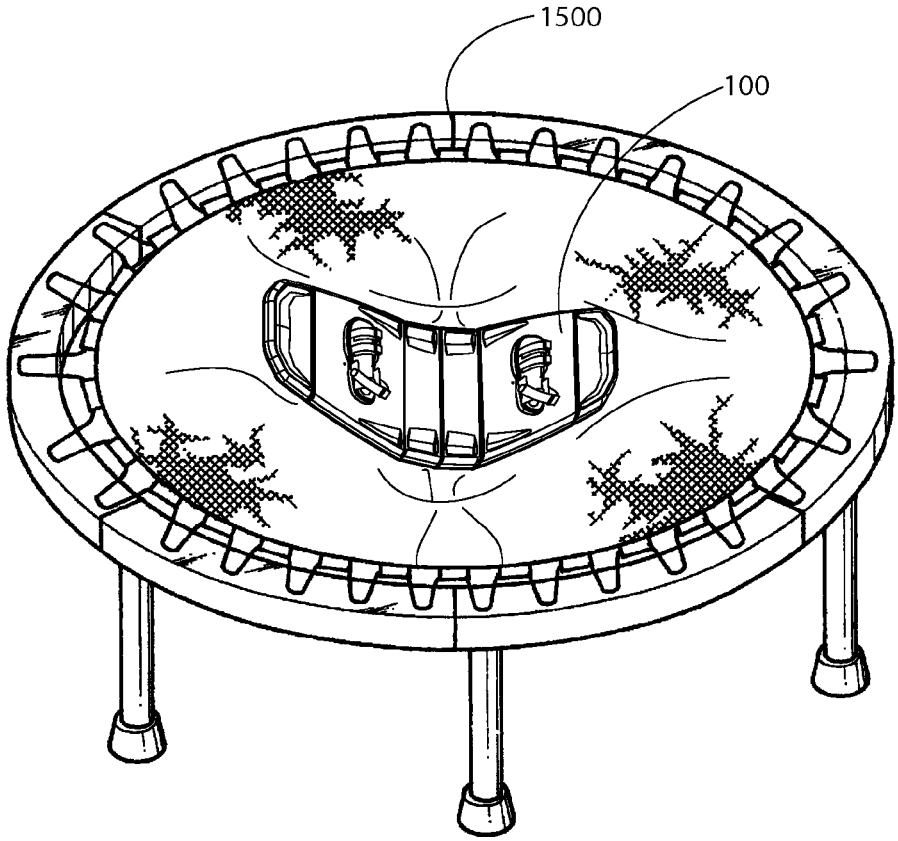
FIG. 15 is a perspective view of a trampoline and an exemplary trampoline board in a bent configuration conforming to the deformed surface of the trampoline in accordance with principles of the invention and FIG. 16 is a perspective view of an alternative exemplary trampoline board in accordance with principles of the invention.

Referring now to FIG. 15, a trampoline 1500 is conceptually illustrated with a trampoline board 100 in accordance with principles of the invention. For clarity, a user is not shown. The trampoline 1500 comprises a piece of taut, strong fabric stretched over a steel frame using many coiled springs to provide a rebounding force which propels the jumper high into the air. The trampoline board 100 conforms to the shape of the deformed fabric surface of the trampoline 1500 during downward deflection. Upon rebound, the trampoline board 100 quickly returns to its undeformed configuration and generally maintains this configuration without appreciable oscillation (i.e., fluttering) throughout aerial maneuvering.

Figure 16:
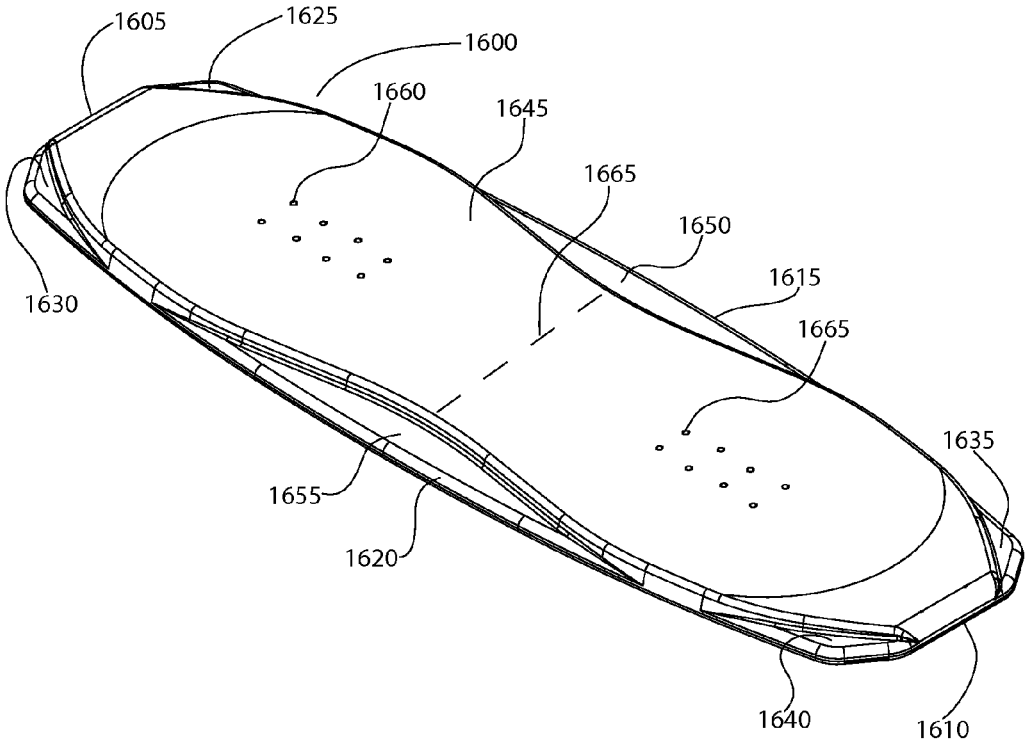

In another embodiment as shown in FIG. 16, features other than furrows, channels or grooves are provided to facilitate flexing. Such features may include thinned regions 1625, 1630, 1635, 1640, 1650, 1655. The thinned regions have a thickness (i.e., thickness measured from top surface to bottom surface) that is less than the thickness of other regions 1645, particularly those regions to which the binding inserts 1660, 1665 are embedded and to which the bindings are attached. These thinned regions 1625, 1630, 1635, 1640, 1650, 1655 are flex zones. By way of example and not limitation, the midline of the board, between tip and tail, may include thinned regions 1650, 1655 near the corresponding lateral edges 1615, 1620. These thinned regions 1650, 1655 are intermediate flex zones. In the exemplary embodiment, the surface area comprising intermediate flexed zones 1650, 1655 is a maximum at the midline, which is where flexibility is desired to easily conform to the deformed surface of a trampoline under tension. The intermediate flex zones 1650, 1655 thus facilitate bending. Other flex zones include corners of the tip 1625, 1630 and tail 1635, 1640. These flex zones yield when a user lands awkwardly on a corner, preventing ankle injury and falling from the trampoline. In sharp contrast, rigid boards, which do not include flex zones, frequently cause injury if a user lands on a corner or tip.

As discussed above, flex zones are portions of reduced thickness (i.e., thickness measured from top surface to bottom surface) at locations on the board (e.g., the midline between tip and tail) where flexibility is desired to easily conform to the deformed surface of a trampoline under tension. Flex zones act as living hinges, which facilitate controlled bending (i.e., bending during impact with a trampoline surface to conform to the shape of the trampoline surface as it deflects). Concomitantly, the board is resilient, returning to its unbent configuration upon rebound, without fluttering while airborne.

While an exemplary embodiment of the invention has been described, it should be apparent that modifications and variations thereto are possible, all of which fall within the true spirit and scope of the invention. With respect to the above description then, it is to be realized that the optimum relationships for the components of the invention, including variations in form, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A trampoline board comprising a resilient body with a foam core, said resilient body resembling a sports board and being sized to attach two feet of a user, said resilient body including top and bottom surfaces, a tip and a tail, and a first and second lateral edges, the top surface including at least one flex zone configured to enable bending of the board to conform to the shape of a depressed trampoline surface, said trampoline board being configured to return to an unbent position upon rebound from a trampoline without fluttering oscillation; and an insert pack molded into the resilient body and configured to threadedly couple the resilient body to trampoline board bindings configured to receive a left foot and right foot of a user and secure the user's left and right feet to the trampoline board, said insert pack comprising a base with a plurality of parallel threaded shanks extending perpendicularly therefrom, each of said threaded shanks having a free end extending to the top surface, and said base being molded into the body between the top and bottom surfaces, and each of said trampoline board bindings including a sole comprising an insole that contacts a user's foot, an outsole that contacts the top surface of the resilient body of the trampoline board, and a shock absorbing midsole, and each of said trampoline board bindings including means for threadedly engaging threaded shanks of said insert pack.

2. A trampoline board according to claim 1, further comprising at least one furrow along a portion of the first lateral edge and at least one furrow along a portion of the second lateral edge.

3. A trampoline board according to claim 1, said at least one flex zone comprising a plurality of parallel channels, each of said plurality of parallel channels extending from the first lateral edge to the second lateral edge, and each of said plurality of parallel channels facilitating bending.

4. A trampoline board according to claim 1, said at least one flex zone comprises a living hinge that facilitates bending.

5. A trampoline board according to claim 1, said trampoline board bindings being sized and configured to accommodate bare feet.

6. A trampoline board according to claim 1, said bindings being devoid of any structure that extends above the ankle of a user.

7. A trampoline board according to claim 1, said trampoline board bindings further comprising at least one cushioned adjustable strap passing over an instep and at least one cushioned adjustable strap passing around a heel, and being devoid of any structure that extends above the ankle of a user.

8. A trampoline board according to claim 1, said trampoline board bindings further comprising a sandal with cushioned adjustable instep strap and a pivotally mounted, cushioned, adjustable heel strap, and being devoid of any structure that extends above the ankle of a user.

9. A trampoline board according to claim 1, said trampoline board bindings further comprising a sandal with a cushioned adjustable instep strap and a pivotally mounted, cushioned, adjustable ankle strap, and being devoid of any structure that extends above the ankle of a user.

10. A trampoline board according to claim 1, said insert pack being an integrated unit with an intermediate stiffening joint.

11. A trampoline board according to claim 1, further comprising an elongated resilient stringer molded into the body parallel to the centerline along the longitudinal axis from tip to tail and between the first and second lateral edges of the resilient body of the trampoline board.

12. A trampoline board according to claim 1, further comprising an elongated perforated resilient stringer molded into the body parallel to the centerline along the longitudinal axis from tip to tail and between the first and second lateral edges of the resilient body of the trampoline board.

13. A trampoline board comprising a resilient body with a foam core, said resilient body resembling a sports board and being sized to attach two feet of a user, said resilient body including top and bottom surfaces, a tip and a tail, and a first and second lateral edges, the top surface including at least one flex zone configured to enable bending of the board to conform to the shape of a depressed trampoline surface, said trampoline board being configured to return to an unbent position upon rebound from a trampoline without fluttering oscillation; and, said foam core comprising a material from the group consisting of:

ethylene vinyl acetate (EVA), high-rebound polyurethane (HRPU), and polyethylene, and said top surface and said bottom surface comprising a skin from the group consisting of high density polyethylene (HDPE), extruded polyurethane, and a spandex fabric with an extruded polyurethane exterior sheet heat laminated to the spandex fabric and forming an outer layer of the top surface.

14. A trampoline board according to claim 13, further comprising an anti-slip pad attached to the bottom surface of the body of the trampoline board.

* * * * *